US010828523B2

(12) United States Patent
Briggs

(10) Patent No.: US 10,828,523 B2
(45) Date of Patent: Nov. 10, 2020

(54) RECTILINEAR POLYHEDRON PROTECTIVE FRAME

(71) Applicant: Jade Briggs, Fayetteville, GA (US)

(72) Inventor: Jade Briggs, Fayetteville, GA (US)

( * ) Notice: Subject to any disclaimer, the term of this patent is extended or adjusted under 35 U.S.C. 154(b) by 54 days.

(21) Appl. No.: 16/021,760

(22) Filed: Jun. 28, 2018

(65) Prior Publication Data

US 2019/0009121 A1 Jan. 10, 2019

Related U.S. Application Data

(60) Provisional application No. 62/528,660, filed on Jul. 5, 2017.

(51) Int. Cl.

| | |
|---|---|
| ***A63B 21/00*** | (2006.01) |
| ***A63B 5/16*** | (2006.01) |
| ***A63B 23/04*** | (2006.01) |

(52) U.S. Cl.

CPC ..... *A63B 21/00047* (2013.01); *A63B 5/16* (2013.01); *A63B 21/4027* (2015.10); *A63B 23/0458* (2013.01); *A63B 2209/00* (2013.01)

(58) Field of Classification Search

CPC ..... A63B 2071/0063; A63B 5/00; A63B 21/00047; A63B 23/0458; A47B 5/043–046

See application file for complete search history.

(56) References Cited

U.S. PATENT DOCUMENTS

| | | | | |
|---|---|---|---|---|
| 4,979,751 | A * | 12/1990 | Sullivan, III | A63B 43/06 273/317 |
| 6,378,831 | B1 * | 4/2002 | Copeland, Jr. | A47B 13/083 108/27 |
| 6,708,941 | B1 * | 3/2004 | Bowen | A47B 95/043 108/27 |
| 2005/0009650 | A1 * | 1/2005 | Sullivan, III | A63B 43/06 473/570 |
| 2015/0231436 | A1 | 8/2015 | Januszek | |
| 2018/0229098 | A1 | 8/2018 | McCorkle | |

FOREIGN PATENT DOCUMENTS

| | | |
|---|---|---|
| GB | 2501613 A | 10/2013 |
| GB | 2524568 A | 9/2015 |

* cited by examiner

*Primary Examiner* — Jennifer Robertson
(74) *Attorney, Agent, or Firm* — Ballard Spahr LLP

(57) ABSTRACT

A protective frame, comprising: a plurality of stripes comprising an elastic material; and configured to cooperate to define a plurality of openings; wherein the frame is configured to be positioned on the edges of a rectilinear polyhedron; and wherein the frame is deformable from a rest position to an operative position; and wherein, in the operative position, the stripes of the frame are configured to cover respective edges of the rectilinear polyhedron.

6 Claims, 2 Drawing Sheets

RECTILINEAR POLYHEDRON PROTECTIVE FRAME

CROSS-REFERENCE TO RELATED APPLICATIONS

This application claims the benefit of priority to U.S. provisional patent application No. 62/528,660, filed Jul. 5, 2017, which is hereby incorporated by reference in their entirety.

FIELD OF INVENTION

This invention relates to protective frames to be positioned on various rectilinear polyhedrons having various dimensions and providing multiple platform surfaces.

BACKGROUND

Scientific evidence over the last decade has demonstrated the efficacy of physical activity improving both physical and cognitive health across the human lifespan. As a result of active promotion of health benefits of the exercise starting at early age and continuing into adulthood, people are looking for new and more efficient ways to improve their physical activities throughout the day. Recently, plyometrics became a popular exercise technique. Plyometrics is a form of exercise performed by athletes to generate fast, powerful movements, either for improving performance in a particular sport (such as basketball, volleyball, or tennis) or to improve fitness generally. Plyometrics involve 'explosive' movements, such as jumping or sudden bursts of acceleration which cause the muscle to be rapidly extended and then contracted. Plyometrics can help in building speed and strength to improve a person's performance of a specific action, such as jumping, running or throwing.

One of the important plyometrics tools is a plyometric box, or plyo box; that is an exercise apparatus that is used to facilitate the performance of certain plyometric exercises. The plyo box provides a raised, stable platform for a person to jump onto and off. A typical plyometric exercise involves a person jumping with both feet onto the platform from a standing start on the ground level and then jumping off the of plyo box to return back to the starting position. Traditional plyo boxes comprise a wooden or metal frame supporting a rigid platform. Such rigid boxes are generally provided in a wide range of sizes and are nestable for storage. A disadvantage that such boxes present is the risk of injury to the user if the user slips or fails to correctly land on the platform while performing the exercise. In some cases failing to correctly land on the platform can results, inter alia, in splinters, bruises, gashes and laceration on the shins and knees of the user. The equipment also needs to be cleaned frequently. Commonly, to solve some of these problems a non-slip flooring cover is positioned underneath of the box and/or the boxes as a whole, or only their edges and/or corners are made from a foam or similar material. These solutions are not always reliable and can make the apparatus more expensive, less durable, and/or more hazardous.

Therefore, it is desirable to provide an improved exercise apparatus for plyometric exercise that addresses the above described problems and/or offers improvements generally.

SUMMARY

Described herein, in one aspect, is a protective frame, comprising: a plurality of stripes comprising an elastic material and configured to cooperate to define a plurality of openings; wherein the frame is configured to be positioned on the edges of a rectilinear polyhedron; and wherein the frame is deformable from a rest position to an operative position; and wherein, in the operative position, the stripes of the frame are configured to cover respective edges of the rectilinear polyhedron.

Further, described herein is a protective frame, comprising: a plurality of separate frame elements configured to be positioned on a height, width, or depths of a rectilinear polyhedron; wherein the each of the plurality of frame elements is deformable from a rest position to an operative position, and wherein in the operative position each of the plurality of frame elements is configured to selectively cover a respective portion of the rectilinear polyhedron and define a respective opening of the frame.

In yet another aspect, described herein is an apparatus comprising: a rectilinear polyhedron; and a removable protective frame; wherein the protective frame comprises a plurality of stripes or a plurality of frame elements covering respective edges of the rectilinear polyhedron without substantially changing dimensions of the 3D rectangular object; and wherein the plurality of stripes or the plurality of frame elements comprise an elastic material.

Additional advantages of the invention will be set forth in part in the description, which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE FIGURES

These and other features of the preferred embodiments of the invention will become more apparent in the detailed description in which reference is made to the appended drawings wherein.

DETAILED DESCRIPTION

Figure 1:
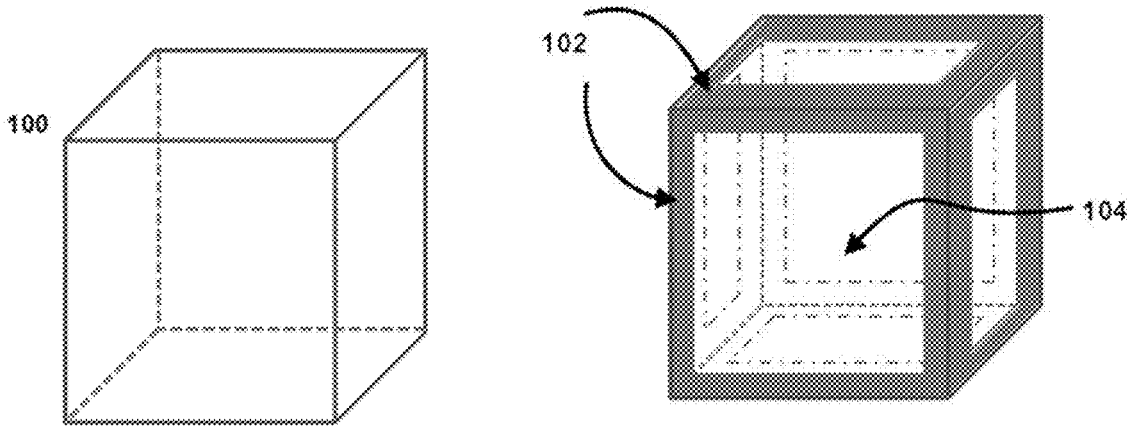
FIG. 1 is a schematic of one exemplary frame and an apparatus disclosed herein.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

A. Definitions

As used throughout, the singular forms "a," "an" and "the" include plural referents unless the context clearly dictates otherwise. Thus, for example, reference to "a stripe" or "a box" can include two or more such stripes or boxes unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or," as used herein, means any one member of a particular list and also includes any combination of members of that list.

The term "rectilinear polyhedron," as used herein refers to a solid in three dimensions with flat polygonal faces, straight edges and sharp corner or vertices. In some embodiments, rectilinear polyhedrons can include but are not limited to a cube, a cuboid, an icosahedron, dodecahedron, a hexagonal prism, a pentagonal pyramid, orthahedron, and the like. It is further understood that the term "polyhedron" as used herein can have any number of faces, for example, 4, 5, 6, 7, 8, 9, 10, 11, 12, or more.

The term "rest position," as described herein, refers to a position when the inventive frame is not in use and no external forces are applied to deform it. It is further understood that in some embodiments the dimensions of the inventive frame in the rest position can be substantially similar to the dimensions of a respective rectilinear polyhedron. In other embodiments, the dimensions of the inventive frame in the rest position are substantially different from the dimensions of a respective rectilinear polyhedron.

The term "operative position," as described herein, refers to a position when the inventive frame is deformed from its rest position to be positioned on a respective rectilinear polyhedron. The deformation of the frame can be done by any known in the art methods. In some unlimiting embodiments the deformation of the frame from the rest position to the operative position can be done by applying an external force, such as stretching of the frame, for example. It is further understood that when the force ceased to be applied, the inventive frame returns to its rest position. It is further understood that in the operative position, the dimensions of the inventive frame are substantially similar to the dimensions of respective rectilinear polyhedron.

It is also to be understood that the mention of one or ore method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

B. Protective Frame

In one aspect, disclosed herein is a protective frame comprising a plurality of stripes comprising an elastic material and configured to cooperate to define a plurality of openings, wherein the frame is configured to be positioned on the edges of a rectilinear polyhedron and wherein the frame is deformable from a rest position to an operative position, and wherein in the operative position the stripes of the frame are configured to cover respective edges of the rectilinear polyhedron. In some other aspects, the plurality of stripes can comprise an elastomeric material. It is understood that the terms "elastic material" and "elastomeric material" can be used interchangeably.

It is understood that the rectilinear polyhedron can be any polyhedron known in the art and applicable for a specific application. For example, and without limitation, in some aspects, the rectilinear polyhedron useful in the exercise can be a cuboid or a cube. In still further aspects, any rectilinear polyhedron known in the art can be utilized as an exercise tool. It is further understood that the protective frame disclosed herein can be utilized in any field that requires a protective coverage of rectilinear polyhedron. In some unlimited examples, the disclosed frame can be used in a moving industry, as a child protection tool for households' items, and the like.

In some aspects, the plurality of stripes is configured to cooperate to define a plurality of openings by permanently connecting one or more of the plurality of stripes. In yet other aspects, the opening formed by the plurality of stripes is sized to substantially expose each of the facets of the rectilinear polyhedron. In still further aspects, the opening formed by the plurality of stripes is sized to allow the rectilinear polyhedron to be inserted within the frame, when the frame is deformed from the rest position to the operative position.

In still further aspects, each of the plurality of stripes can have a length configured to substantially fit a size of the rectilinear polyhedron in use. In some aspects, the plurality of stripes can have a different length configured to fit a respective height, width, and depth of the rectilinear polyhedron. In still further aspects, the frame can have a web-like structure allowing the plurality of stripes to surround respective edges of the rectilinear polyhedron.

In still further aspects, the stripes of the protective frame can have any width allowing the frame to substantially fit the edges of the rectilinear polyhedron in the operative position in such way that the frame remains positioned on the rectilinear polyhedron during its use.

It is understood that in certain aspects, when the frame is in the operative position there is no substantial change in a respective height, width, and/or depth of the rectilinear polyhedron. In yet other aspects, the frame when it is in the operative position, a change in a respective height, width, and/or depth is not larger than about 0.01% of the original value, about 0.05% of the original value, about 0.1% of the original value, about 0.5% of the original value, about 1% of the original value, about 2% of the original value, about 3% of the original value, about 4% of the original value, about 5% of the original value, about 6% of the original value, about 7% of the original value, about 8% of the original value, about 9% of the original value, about 10% of the original value, about 15% of the original value, about 20% of the original value, about 25% of the original value, or about 30% of the original value. In yet other aspects, the change is about 5% of the original value.

In still further aspects, disclosed herein is a protective frame comprising a plurality of separate frame elements configured to be positioned on a height, width, or depths of a rectilinear polyhedron, wherein each of the plurality of frame elements is deformable from a rest position to an operative position, and wherein in the operative position each of the plurality of frame elements is configured to selectively cover a respective portion of the rectilinear polyhedron and define a respective opening of the frame.

In such exemplary aspects, each of the plurality of frame elements is not permanently connected to each other either in the rest or the operative position. In certain aspects, the plurality of frame elements can comprise a band sized to substantially fit a perimeter of the rectilinear polyhedron facet when it is deformed from the rest position to the operative position. In yet other aspects, the protective frame can comprise the plurality of separate frame elements comprising an elastic band deformable such that the elastic band covers the edges of a respective edge of the rectilinear polyhedron and the opening of the frame exposes at least a portion of a facet side of the rectilinear polyhedron.

In yet other aspects, the plurality of separate frame elements can comprise stripes, wherein each of the stripes can be configured to be positioned on the respective edge of the rectilinear polyhedron and connected with at least one another stripe to substantially fit a perimeter of the rectilinear polyhedron facet. In still further aspects, the plurality of separate frame elements can comprise a corner cover. In these aspects, each of the separate frame elements is positioned on the respective edges of the rectilinear polyhedron without covering the full perimeter of the rectilinear polyhedron facet.

In any of the aspects where the plurality of separate frame elements are used to form the protective frame, the at least one of the plurality of frame elements is selectively attachable to the band of the at least one another frame element of the plurality of frame elements. Further aspects, the at least one of the plurality of frame element of the plurality of frame elements is selectively attachable to the stripe of the at least one another frame element of the plurality of frame elements.

In still other aspects, the plurality of frame elements in the rest position can have the same or the different length from a respective height, width, and/or depth of the rectilinear polyhedron. In some aspects, in the operative position at least one frame element of the plurality of frame elements overlaps with at least one another frame element of the plurality of frame elements.

In still further aspects, the frame can comprise any materials known in the art that can allow deformability from the rest position to the operative position. In some aspects, the frame comprises a plurality of stripes. In such aspects, the plurality of stripes can comprise any elastic material known in the art. In yet other aspects, the plurality of stripes can comprise any elastomeric material known in the art. In some aspects, the elastic material or the elastomeric material can comprise a polymer selected from the group consisting of a natural rubber, a polyurethane, a silicone rubber, a neoprene rubber, a fluoropolymer elastomer, a nitrile rubber, a butyl rubber, a synthetic rubber, a thermoplastic elastomer, and any combination thereof. In other aspects, the elastic material or elastomeric material is a polyurethane. In still further aspects, the elastic material or elastomeric material is a silicone rubber. In still further aspects, the elastic material or elastomeric materila is a neoprene rubber. In still further aspects, the elastic material or elastomeric material is a fluoropolymer elastomer. In still further aspects, the elastic material or elastomeric material is a nitrile rubber. In still further aspects, the elastic material or elastomeric material is a butyl rubber. In still further aspects, the elastic material or elastomeric materila is a synthetic rubber. In still further aspects, the elastic material or elastomeric material is a thermoplastic rubber. In yet still further aspects, the elastic material or elastomeric material can comprise any combination of the mentioned above rubbers.

In the aspects, wherein the frame comprises the plurality of frame elements, each of the separate frame elements can comprise the same or the different material. In some aspects, each of the separate frame elements can comprise any material known in the art that allows desired deformability of the frame elements from the rest position to the operative position. In certain aspects, the separate frame elements can comprise a polymer selected from the group consisting of a natural rubber, a polyurethane, a silicone rubber, a neoprene rubber, a fluoropolymer elastomer, a nitrile rubber, a butyl rubber, a synthetic rubber, a thermoplastic elastomer, and any combination thereof. In other aspects, at least one of the frame elements is a polyurethane. In still further aspects, at least one of the frame elements is a silicone rubber. In still further aspects, at least one of the frame elements is a neoprene rubber. In still further aspects, at least one of the frame elements is a fluoropolymer elastomer. In still further aspects, at least one of the frame elements is a nitrile rubber. In still further aspects, at least one of the frame elements is a butyl rubber. In still further aspects, at least one of the frame elements is a synthetic rubber. In still further aspects, at least one of the frame elements is a thermoplastic rubber. In yet still further aspects, at least one of the frame elements can comprise any combination of the mentioned above rubbers.

In further aspects, wherein the plurality of frame elements are used in the protective frame, each of the plurality of frame elements comprises a fastener configured to secure the frame elements to the rectilinear polyhedron. In yet other aspects, each of the plurality of frame elements comprises a fastener configured to secure each of the frame elements to each other.

In some aspects, the fastener can be any fastener in the art allowing attachment between any two articles and capable of securing the frame elements to each other or to the rectilinear polyhedron. In certain aspects, the fastener can comprise a hook and loop fastener, an adhesive, a screw, a magnet, or any combination thereof. For example and without limitation, the fastener can comprise a Velcro®. In yet other exemplary aspects, the frame elements can comprise a self-adhesive material that allows a removal bonding between the frame elements or between the frame elements and the rectilinear polyhedron.

In still further aspects, disclosed herein is a method of using the disclosed protective frame. In certain aspects, the method comprises a method of positioning the disclosed protective frame on a rectilinear polyhedron comprising deforming the plurality of stripes from a rest position to an operative position, wherein in the operative position the frame openings are sufficiently increased to insert the rectilinear polyhedron into the frame, and wherein in the operating position the stripes of the frame cover respective edges of the rectilinear polyhedron. In these aspects, the width of the plurality of stripes is sized to substantially fit the respective edges of the rectilinear polyhedron without substantially changing the height, width and/or the depth of the rectilinear polyhedron while allowing the frame to stay on the rectilinear polyhedron without slipping. In some aspects, the width of each of the plurality of stripes is from about 20 to about 100 mm, including exemplary values of about 25 mm, about 30 mm, about 35 mm, about 40 mm, about 45 mm, about 50 mm, about 55 mm, about 60 mm, about 65 mm, about 70 mm, about 75 mm, about 80 mm, about 85 mm, about 90 mm, and about 95 mm.

It is understood that the disclosed protective frame when is used in the operative condition does not substantially alter the height, width, and/or depth of the rectilinear polyhedron. In some aspects, the thickness of each of the plurality of stripes and/or the plurality of frame elements is from about 5 mm to about 20 mm, including exemplary values of about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, and about 19 mm. In yet other aspects, the thickness of each of the plurality of stripes and/or the plurality of frame elements is from about 5 mm to about 10 mm, including exemplary values of about 6 mm, about 7 mm, about 8 mm, and about 9 mm. It is further understood that the thickness of each of the plurality of stripes and/or the plurality of frame elements can be the same or the different in the rest and operative positions. In certain aspects, the thickness of the each of the plurality of stripes and/or the plurality of frame elements in the rest position is larger than the thickness of the each of the plurality of stripes and/or the plurality of frame elements in the operative position.

In still further aspects, disclosed herein a method comprising a method of positioning the protective frame comprising a plurality of frame elements on the rectilinear polyhedron comprising deforming at least one of the plurality of the frame elements from a rest position to an operative position, wherein in the operative position each of the frame element is deformed to insert a respective edge of the rectilinear polyhedron. In other aspects, an additional frame element of the plurality of frame elements can be further deformed from a rest position to an operative position and placed on a separate respective edge of the rectilinear polyhedron. It is further understood that in such aspects, one or more separate frame elements can overlap with each other. In yet other aspects, the method comprises positioning the frame comprising a plurality frame elements on a rectilinear polyhedron comprising separately deforming each of the plurality of frame elements from a rest position to an operative position to cover a respective edge of the rectilinear polyhedron, wherein the at least one frame element of the plurality of frame elements covers at least another frame element.

It is further understood that any disclosed herein protective frame can be reusable and can be made to fit any known in the art rectilinear polyhedron. It is understood that if the rectilinear polyhedron is used as a plyo box tool, the protective frame can be used individually by an athlete and can be reused for any plyo box.

C. Apparatus

Further disclosed herein is an apparatus comprising a rectilinear polyhedron and a removable protective frame, wherein the protective frame comprises a plurality of stripes or a plurality of frame elements covering respective edges of the rectilinear polyhedron without substantially changing dimensions of the three-dimensional (3D) rectangular object, and wherein the plurality of stripes or the plurality of frame elements comprise an elastic material.

It is understood that the rectilinear polyhedron can be any rectilinear polyhedron known in the art. In exemplary aspects the rectilinear polyhedrons can include but are not limited to a cube, a cuboid, an icosahedron, dodecahedron, a hexagonal prism, a pentagonal pyramid, orthahedron, and the like. It is further understood that these rectilinear polyhedrons can be used in any field, for example and without limitation, they can be used as a plyo box tool, a table, any box, a chair, a refrigerator, a credenza, and the like. In some aspects, the rectilinear polyhedron can comprise a wooden material, a metal material, a compound material, a plastic material, or a combination thereof. In certain aspects, the rectilinear polyhedron can have the same length of the height, width, and depth. In yet other aspects, the rectilinear polyhedron can have the height, width, and depth that are all of different length from one another.

A first exemplary frame and an apparatus are demonstrated in FIG. 1. As shown here the rectilinear polyhedron 100 is inserted into the protective frame 102. In this exemplary aspect, the protective frame comprises a plurality of stripes configured to cooperate to define a plurality of openings 104. This protective frame is shown to be in its operative position when it is positioned on the edges of a rectilinear polyhedron.

Figure 2:
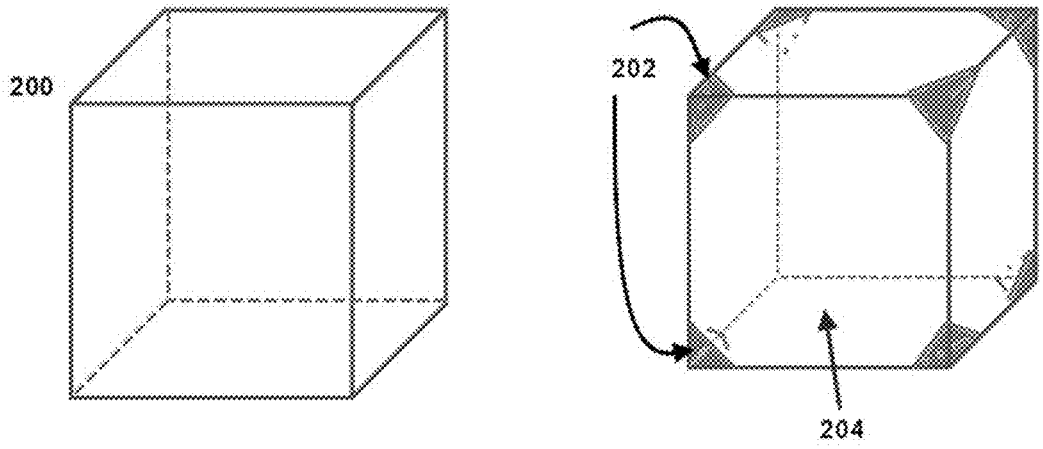
FIG. 2 is a schematic of another exemplary frame and an apparatus disclosed herein.

Another exemplary protective frame and apparatus are demonstrated in FIG. 2. In this exemplary aspect, the rectilinear polyhedron 200 has a protective frame comprising a plurality of frame elements 202, where the polyhedron facets 204 are fully exposed. In this aspect, the plurality of frame elements comprises a corner coverings of the respective edges of the rectilinear polyhedron.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A method of positioning a protective frame of on a rectilinear polyhedron, the protective frame comprising:

a plurality of stripes comprising an elastic material and configured to cooperate to define six openings;

wherein the frame is configured to be positioned on all edges of a rectilinear polyhedron being a cuboid; and wherein the frame is deformable from a rest position to an operative position; and wherein, in the operative position, the stripes of the frame are configured to cover all respective edges of the rectilinear polyhedron, wherein the method comprises deforming the plurality of stripes from a rest position to an operative position, wherein in the operative position the frame openings are sufficiently increased to insert the rectilinear polyhedron into the frame, and wherein in the operating position the stripes of the frame cover respective edges of the rectilinear polyhedron.

2. A method of positioning a protective frame on a rectilinear polyhedron, the protective frame comprising:

a plurality of separate frame elements configured to be positioned on all edges of a rectilinear polyhedron being a cuboid;

wherein the each of the plurality of frame elements is deformable from a rest position to an operative position, and wherein in the operative position each of the plurality of frame elements is configured to selectively cover a respective edge of the rectilinear polyhedron and define a respective opening of the frame, wherein the frame comprises six openings, wherein the method comprises separately deforming each of the plurality of frame elements from a rest position to an operative position to cover a respective edge of the rectilinear polyhedron, wherein the at least one frame element of the plurality of frame elements covers at least another frame element.

3. An apparatus, comprising:

a rectilinear polyhedron being a cuboid; and a removable protective frame; wherein the protective frame comprises a plurality of stripes or a plurality of frame elements covering all respective edges of the rectilinear polyhedron being a cuboid without substantially changing dimensions of the rectilinear polyhedron being a cuboid; wherein the plurality of stripes cooperate to define six openings, and wherein the plurality of stripes or the plurality of frame elements comprise an elastic material.

4. The apparatus of claim 3, wherein the rectilinear polyhedron has the height, width and depth that are all of different lengths from one another.

5. The apparatus of claim 3, wherein the elastic material comprises a polymer selected from the group consisting of a natural rubber, a polyurethane, a silicone rubber, a neoprene rubber, a fluoropolymer elastomer, a nitrile rubber, a butyl rubber, a synthetic rubber, a thermoplastic elastomer, and any combination thereof.

6. The apparatus of claim 3, wherein there is no substantial change in a respective height, width and depth of the rectilinear polyhedron.

* * * * *